US008128255B2

(12) United States Patent
Yeh

(10) Patent No.: US 8,128,255 B2
(45) Date of Patent: Mar. 6, 2012

(54) STRUCTURE FOR SECURING CONDUCTIVE STRIP OF FLASHLIGHT

(75) Inventor: Hsueh-Chu Yeh, Tainan (TW)

(73) Assignee: Day Sun Industrial Corp., Tainan (TW)

( * ) Notice: Subject to any disclaimer, the term of this patent is extended or adjusted under 35 U.S.C. 154(b) by 312 days.

(21) Appl. No.: 12/485,104

(22) Filed: Jun. 16, 2009

(65) Prior Publication Data

US 2010/0315808 A1 Dec. 16, 2010

(51) Int. Cl.
*F21L 4/00* (2006.01)
*F21L 4/04* (2006.01)

(52) U.S. Cl. ..... 362/204; 362/196; 362/197; 362/198; 362/199; 362/200; 362/201; 362/202; 362/203; 362/205; 362/206; 362/207; 362/208

(58) Field of Classification Search ..... 362/196–208
See application file for complete search history.

(56) References Cited

U.S. PATENT DOCUMENTS 6,168,288 B1 * 1/2001 St. Claire ..... 362/208
6,283,611 B1 * 9/2001 Sharrah et al. ..... 362/204

* cited by examiner

*Primary Examiner* — William Carter
(74) *Attorney, Agent, or Firm* — Alan Kamrath; Kamrath IP Lawfirm, PA

(57) ABSTRACT

A structure for securing a conductive strip of a flashlight includes a flashlight main body formed therein with a receiving space for receiving batteries. The receiving space has a lateral surface formed with a groove whose cross-section tapers toward the center of the receiving space and is configured for receiving the conductive strip coupled to a switch assembly, along with an insulating element corresponding in width to the conductive strip and having a predetermined length. Once installed in the flashlight main body, the conductive strip is separated from the batteries in the receiving space, thereby preventing the batteries from overheating, which might otherwise result from direct contact with the conductive strip. The main body further has a rear end coupled with a pressing portion formed of a pliable material such that a switch of the switch assembly is switched on or off by pressing the pressing portion.

2 Claims, 5 Drawing Sheets

STRUCTURE FOR SECURING CONDUCTIVE STRIP OF FLASHLIGHT

BACKGROUND OF THE INVENTION

1. Technical Field

The present invention relates to a structure for securing a conductive strip of a flashlight intended for illumination purposes and, in particular, for securing the conductive strip installed in the flashlight separated from batteries loaded in the flashlight such that when the flashlight is powered on, the batteries are prevented from the danger of overheating, which might otherwise result from extended contact with the conductive strip.

2. Description of Related Art

Nowadays, flashlights are available in a variety of configurations. Basically, a flashlight includes a flashlight main body having a predetermined shape. In addition, a switch is provided on an outer surface of the flashlight main body to make or break the electrical connection between a conductive strip installed in the flashlight and batteries loaded in the flashlight. The conductive strip is installed in such a way to make direct contact with the batteries. As a result, when the flashlight is turned on for a long time, the batteries, which are in constant contact with the conductive strip, are subject to the danger of overheating.

BRIEF SUMMARY OF THE INVENTION

In view of the aforementioned drawbacks of the existing flashlights designed for illumination purposes, the present invention provides an improvement in which a conductive strip is installed in a flashlight in such a way to be separated from batteries received in the flashlight. Thus, when the flashlight is powered on, the separation between the conductive strip and the batteries prevents the batteries from the danger of overheating, which might otherwise result from long-term contact with the conductive strip.

A primary objective of the present invention is to provide a structure for securing a conductive strip of a flashlight. The structure includes a flashlight main body formed therein with a receiving space for receiving one or more batteries. In addition, the receiving space of the flashlight main body has a lateral surface formed with a groove whose cross-section tapers toward the center of the receiving space and is configured for receiving the conductive strip together with an insulating element. The conductive strip is coupled to an end of a switch assembly, and the insulating element corresponds in width to the conductive strip and has a predetermined length. Therefore, once installed in the main body, the conductive strip is separated from each of the batteries received in the receiving space. In consequence, when the flashlight is turned on for a long time, the batteries are prevented from overheating, which might otherwise result from direct contact with the conductive strip.

A secondary objective of the present invention is to provide the foregoing structure with the flashlight main body further having a rear end coupled with a pressing portion formed of a pliable material. By pressing the pressing portion, a switch of the switch assembly located inside the flashlight main body and corresponding in position to the pressing portion is switched on or off.

BRIEF DESCRIPTION OF THE SEVERAL VIEWS OF THE DRAWINGS

The invention as well as a preferred mode of use, further objectives, and advantages thereof will be best understood by referring to the following detailed description of an illustrative embodiment in conjunction with the accompanying drawings, wherein:

FIG. 5 is another sectional view of the flashlight assembly according to the present invention, with the flashlight assembly loaded with batteries and powered on.

DETAILED DESCRIPTION OF THE INVENTION

Figure 2:
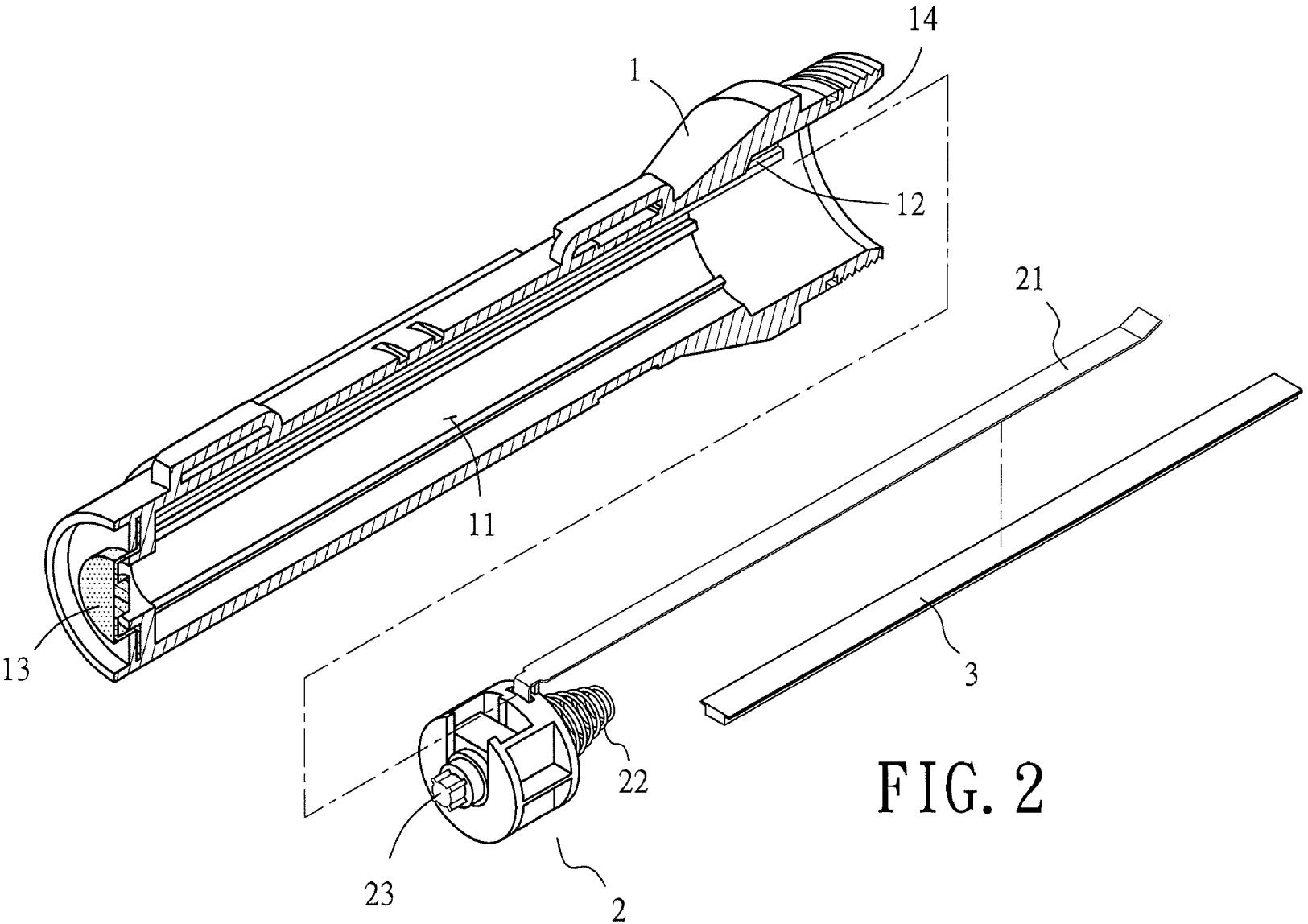
FIG. 2 is an exploded perspective view of the flashlight assembly according to the present invention.
Figure 3:
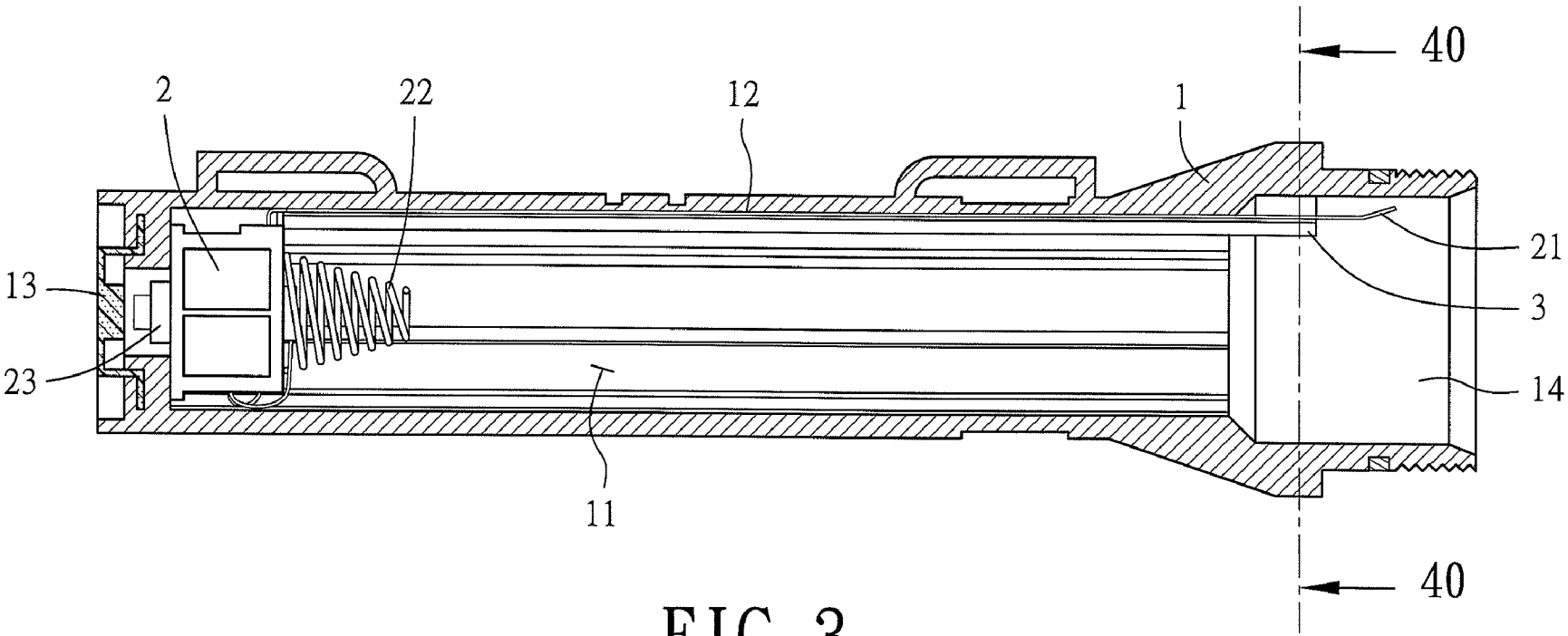
FIG. 3 is a sectional view of the flashlight assembly according to the present invention.
Figure 4:
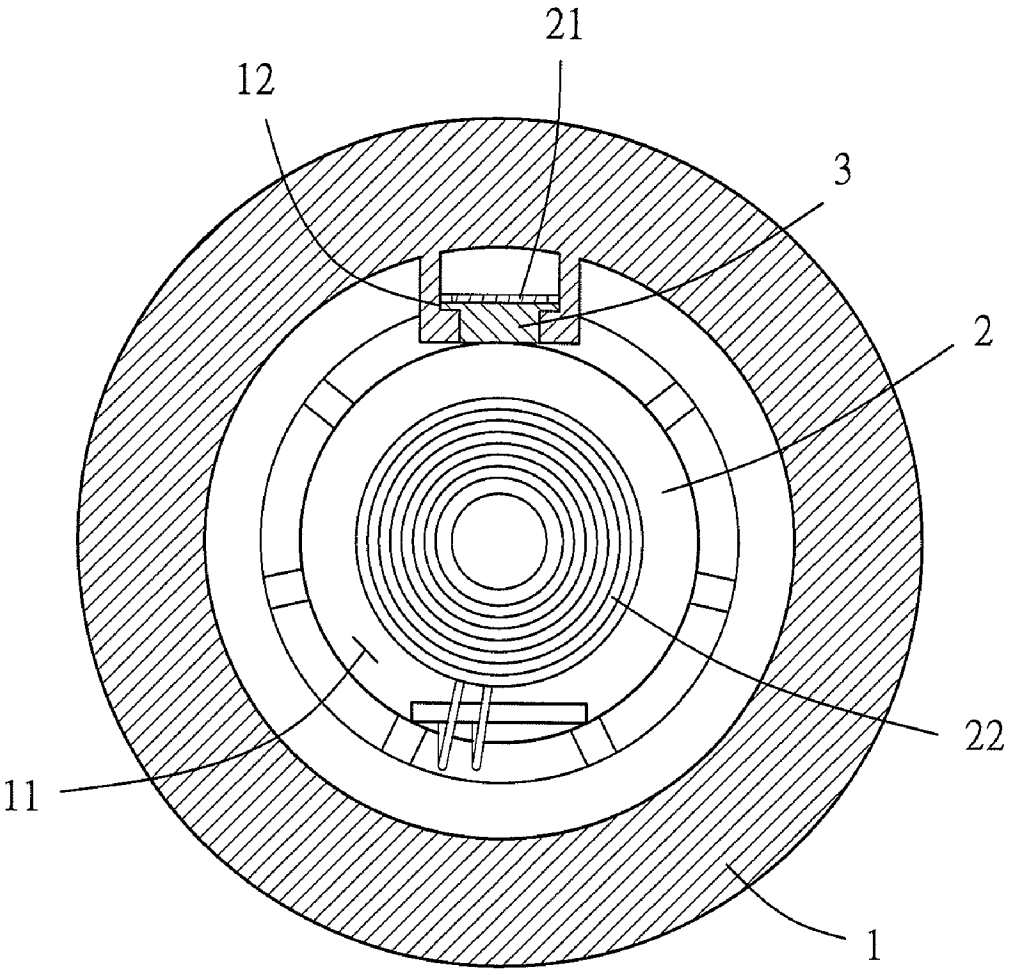
FIG. 4 is a sectional view taken along Line 40-40 of FIG. 3.

Referring to FIGS. 2 to 4, a structure for securing a conductive strip 21 of a flashlight 6 according to the present invention essentially includes a flashlight main body 1, a switch assembly 2, and an insulating element 3.

Figure 5:
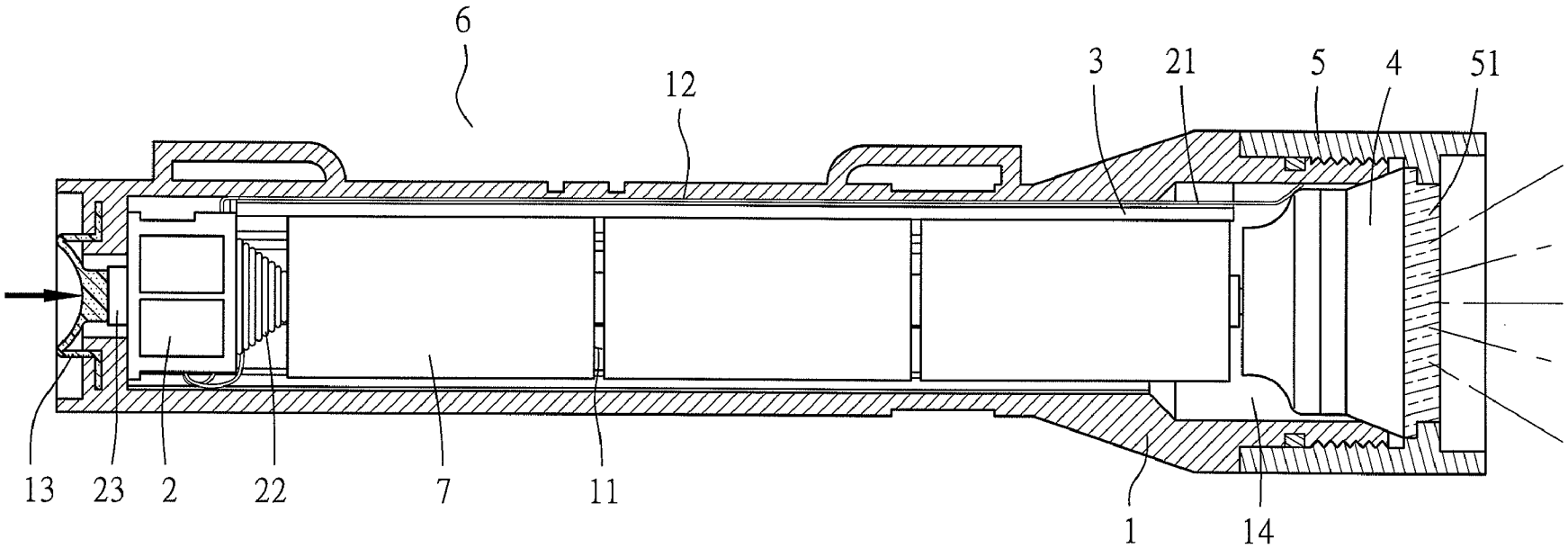

The flashlight main body 1 is formed therein with a receiving space 11 for receiving one or more batteries 7, as shown in FIG. 5. The receiving space 11 of the flashlight main body 1 has a lateral surface formed with a groove 12 whose cross-section tapers toward the center of the receiving space 11, as shown in FIGS. 2, 3, and 4. In addition, the flashlight main body 1 has a rear end coupled with a pressing portion 13 formed of a pliable material.

Referring to FIG. 2, a conductive strip 21 is coupled to the switch assembly 2 near an inward end of the switch assembly 2. A spring 22 is mounted at the inward end of the switch assembly 2 for making electrical contact with the batteries 7 received in the flashlight main body 1, as shown in FIG. 5. The switch assembly 2 also has an outward end provided with a push-type switch 23 for making and breaking electrical connection with the batteries 7.

As shown in FIG. 2, the insulating element 3 is a separation element having a predetermined length and a width corresponding to a width of the conductive strip 21 coupled with the switch assembly 2. In the present embodiment, the insulating element 3 is a plastic strip having an upper portion and a lower portion narrower than the upper portion. Thus, when the insulating element 3 is fitted in the groove 12 along with the conductive strip 21 coupled with the switch assembly 2, the conductive strip 21 is secured in position to the groove 12 by the insulating element 3, as shown in FIGS. 3 and 4.

Figure 1:
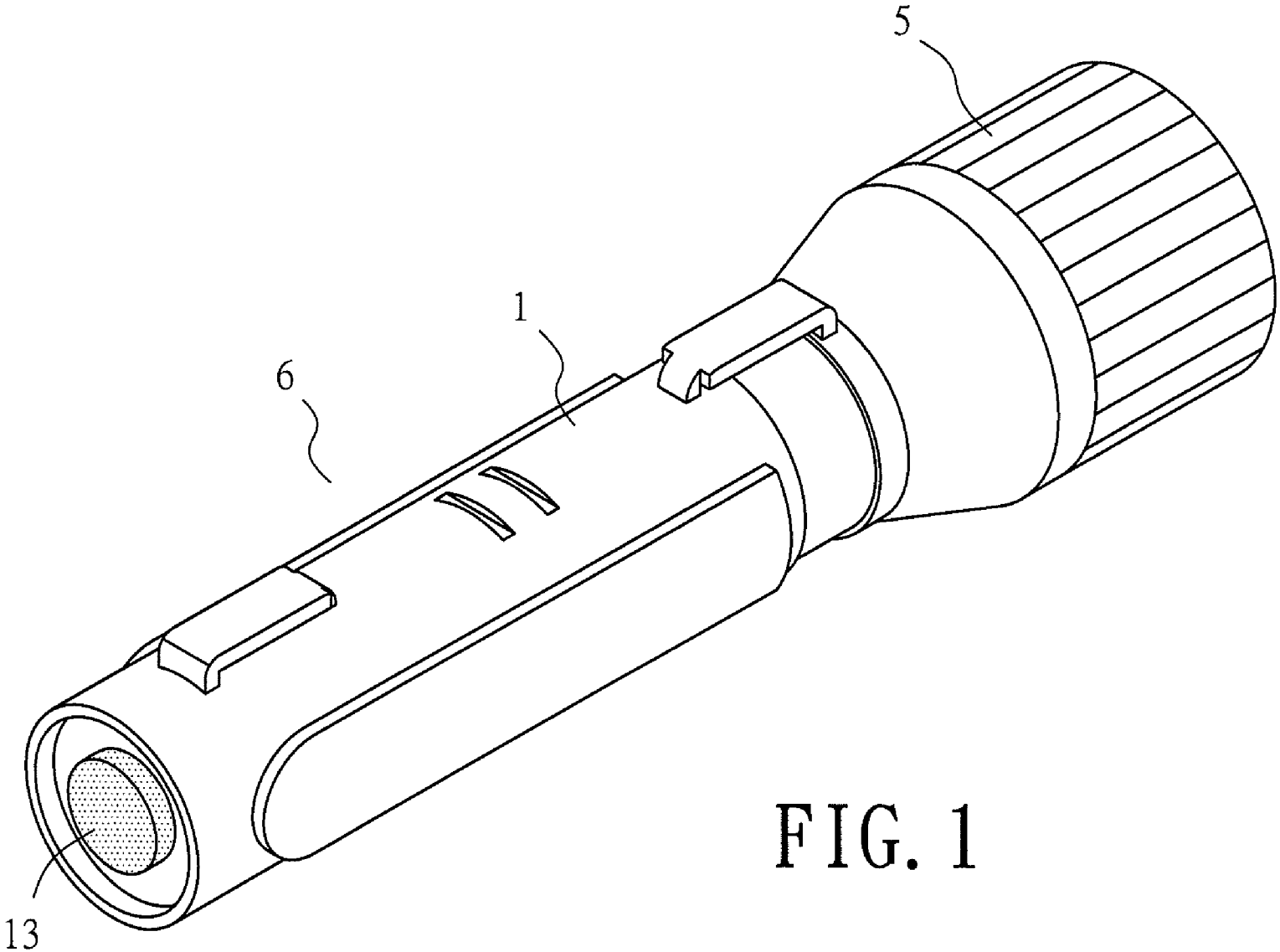
FIG. 1 is a perspective view of a flashlight assembly according to the present invention.

Referring to FIGS. 2 through 4, the flashlight main body 1, the switch assembly 2, and the insulating element 3 are assembled together in the following manner. To begin with, the conductive strip 21 coupled to the switch assembly 2 near the inward end thereof is fitted, along with the insulating element 3, into the groove 12 formed on the lateral surface of the receiving space 11 of the flashlight main body 1, as shown in FIGS. 3 and 4, such that the insulating element 3 secures the conductive strip 21 in position to the groove 12. Then, the one or more batteries 7 are loaded into the receiving space 11 formed inside the flashlight main body 1, as shown in FIG. 5. Afterward, a light 4 and a cap 5 which is coupled with a light-transmitting cover 51 are fastened threadingly to a front opening 14 of the flashlight main body 1, thus completing the flashlight 6, as shown in FIG. 1.

Operation of the assembled flashlight 6 is illustrated in FIG. 5. A user can press the pressing portion 13 at a rear end of the flashlight 6 so as to switch on the switch 23 of the switch assembly 2 installed inside the main body 1 and corresponding in position to the pressing portion 13. The switch 23 of the switch assembly 2 is switched off by pressing the pressing portion 13 again. When the flashlight 6 is powered on, the conductive strip 21 installed in the flashlight main body 1 is separated from each of the batteries 7 received in the receiving space 11. Therefore, even though the flashlight 6 is turned on for a long time, the batteries 7 are prevented from the danger of overheating, which might otherwise result from direct contact between the conductive strip 21 and the batteries 7.

What is claimed is:

1. A flashlight structure comprising:

a conductive strip;

a flashlight main body formed therein with a receiving space for receiving one or more batteries, wherein the receiving space of the flashlight main body has a lateral surface formed with a groove whose cross-section tapers toward a center of the receiving space and is configured for receiving the conductive strip;

a switch assembly near an inward end of the flashlight main body; and an insulating element corresponding in width to the conductive strip, having a predetermined length and received in the groove of the flashlight main body, with the conductive strip, when installed in the groove of the flashlight main body, separated from each said battery received in the receiving space by the insulating element, with the conductive strip being secured in position to the groove by the insulating element, whereby when the flashlight is turned on for a long time, the one or more batteries are prevented from the danger of overheating, which might otherwise result from direct contact with the conductive strip.

2. The flashlight structure of claim 1, wherein the flashlight main body has a rear end coupled with a pressing portion formed of a pliable material, with a switch of the switch assembly installed inside the flashlight main body and corresponding in position to the pressing portion being switched on or off by pressing the pressing portion.

* * * * *